US006865780B2

(12) United States Patent
Heinz et al.

(10) Patent No.: US 6,865,780 B2
(45) Date of Patent: Mar. 15, 2005

(54) METHOD OF AND APPARATUS FOR CONTROLLING THE SUCTION IN A THREAD-BREAKAGE SUCTION UNIT OF A TEXTILE MACHINE

(75) Inventors: Werner Heinz, Ebersbach/Fils (DE); Reinhard Grauli, Weilheim (DE); Günter Neuburger, Geislingen (DE); Martin Mense, Holzminden (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 129 days.

(21) Appl. No.: 10/211,254

(22) Filed: Aug. 2, 2002

(65) Prior Publication Data

US 2003/0037532 A1 Feb. 27, 2003

(30) Foreign Application Priority Data

Aug. 9, 2001 (DE) ..... 101 39 077

(51) Int. Cl.[7] ..... D01G 15/76

(52) U.S. Cl. ..... 19/107; 19/115 B; 19/303; 95/26; 96/424; 134/21; 134/122 R

(58) Field of Search ..... 95/19, 22, 26; 96/421, 422, 397, 400, 403, 424; 15/319; 19/107, 303, 115 B; 134/21, 104.2, 122 R

(56) References Cited

U.S. PATENT DOCUMENTS

| | | | | |
|---|---|---|---|---|
| 2,431,726 A | * | 12/1947 | Bechtler | 57/304 |
| 2,976,668 A | * | 3/1961 | Reiterer | 57/305 |
| 3,276,065 A | * | 10/1966 | King, Jr. et al. | 15/312.2 |
| 3,471,890 A | * | 10/1969 | Ramo | 15/301 |
| 3,486,309 A | * | 12/1969 | Wild | 96/428 |
| 3,612,616 A | * | 10/1971 | Stewart | 406/172 |
| 3,627,584 A | * | 12/1971 | Stewart | 134/21 |
| 4,399,585 A | * | 8/1983 | Kullik et al. | 15/319 |
| 4,753,665 A | | 6/1988 | Fahey | |
| 4,820,317 A | * | 4/1989 | Fahey | 95/22 |
| 4,991,253 A | * | 2/1991 | Rechsteiner | 15/301 |

* cited by examiner

*Primary Examiner*—Duane S. Smith
(74) *Attorney, Agent, or Firm*—Herbert Dubno

(57) ABSTRACT

A method and a device for controlling the suction, by speed alteration of a blower motor, in a unit for suctioning away thread breakage in a textile machine. A standard speed of the blower motor without speed control is established to achieve the suction, after which the speed of the blower motor is so controlled that a set suction is reached and maintained.

8 Claims, 1 Drawing Sheet

METHOD OF AND APPARATUS FOR CONTROLLING THE SUCTION IN A THREAD-BREAKAGE SUCTION UNIT OF A TEXTILE MACHINE

FIELD OF THE INVENTION

Our present invention relates to a method of and to a device for controlling the suction, by speed changes of a blower motor, in a thread-breakage suction unit of a textile machine. The invention can be used especially in ring-spinning machines and roving machines (flyers).

More specifically, the invention relates to a method of operating a residue-suction unit of a textile machine having a suction blower which is driven by an electric motor.

FIELD OF THE INVENTION

In the state of the art there is already a device by means of which the suction in a thread-breakage suction unit is controlled to a certain level by the speed change of the blower motor (U.S. Pat. No. 4,753,665). This known device does not react to negative effects in practice, for example, plugging up of the suction line, or reacts to such events in a poor manner.

OBJECTS OF THE INVENTION

It is an object of the present invention to provide a method and a device of the type set forth at the outset which is substantially more flexible in reacting to defects which arise in practice.

Another object of this invention is to provide a method of operating a residue-suction unit of a textile machine so that the system is more responsive to the various machine conditions and the suction action is more efficient.

SUMMARY OF THE INVENTION

This object is achieved according to the invention in that a set standard speed of the blower motor is preselected to achieve the suction, after which the speed of the blower motor is so controlled that a certain suction is achieved and maintained.

More specifically, the invention involves a method of operating a residue-suction unit of the textile machine which comprises the steps of:

(a) driving the blower at an unregulated standard speed with an electric motor having the standard speed until a suction level characteristic of the standard speed is reached in the unit; and (b) thereafter controlling the speed of the motor to establish and maintain a predetermined suction level sufficient to ensure that yarn residues will be drawn into the unit.

The reference here to an electric motor with an unregulated standard speed is intended to describe a motor which, at the normal operating voltage and other electrical energization conditions has a certain speed which is fixed in practice and normally does not change. Nevertheless, the motor can be controllable, e.g. with an electronics speed controller in accordance with the invention, and once the standard speed is obtained can be maintained at a higher or lower speed than the standard speed by the control circuitry so that the selected higher or lower speed is maintained substantially constant.

Thus the invention provides that a standard speed of the motor, normally characteristic of the standard operating conditions of the motor is used to generate the normal suction which can lie within a customary range. Only when this suction is achieved is the control activated and the speed of the blower motor so regulated that a certain suction level is maintained. The system can then be switched back to the aforementioned standard speed under certain conditions, i.e. when the suction pressure, as detected by sensors oversteps or understeps limits to a certain extent. This can be the case for example upon opening of the filter chamber to remove the waste, upon failure of a sensor detecting a suction pressure, upon blockage of the suction line or similar suction source. When the aforementioned sensor again detects a correct suction pressure, the control operation is again activated. If the standard speed of the blower motor continues for an extended adjustable time, it is determined that a problem or defect has arisen whereupon the defect signal is triggered acoustically and/or optically.

According to the invention it is also possible to move to the standard speed of the blower motor also upon a sharp increase or drop in the suction pressure.

According to the invention, the standard speed is within a fixed range.

The switchover from the standard speed to the predetermined suction level which is maintained by the control system can be effected after the standard speed has been maintained for a brief period. Switching back to the standard speed occurs when the detected pressure (U) exceeds or understeps predetermined limits and within activation of the speed control.

The speed control is reactivated when the certain suction pressure (U) is again detected, the suction pressure (U) can then be a sensor-determined suction pressure.

The failure signal can be triggered when the standard speed is effective for an adjustable time period or in response to a sharp increase or sharp drop in the suction pressure.

The device for controlling the suction by speed change of a blower motor has a control unit connected with the blower motor for producing a suction source at a predetermined standard speed whereupon the control is effected to an adjustable suction pressure.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
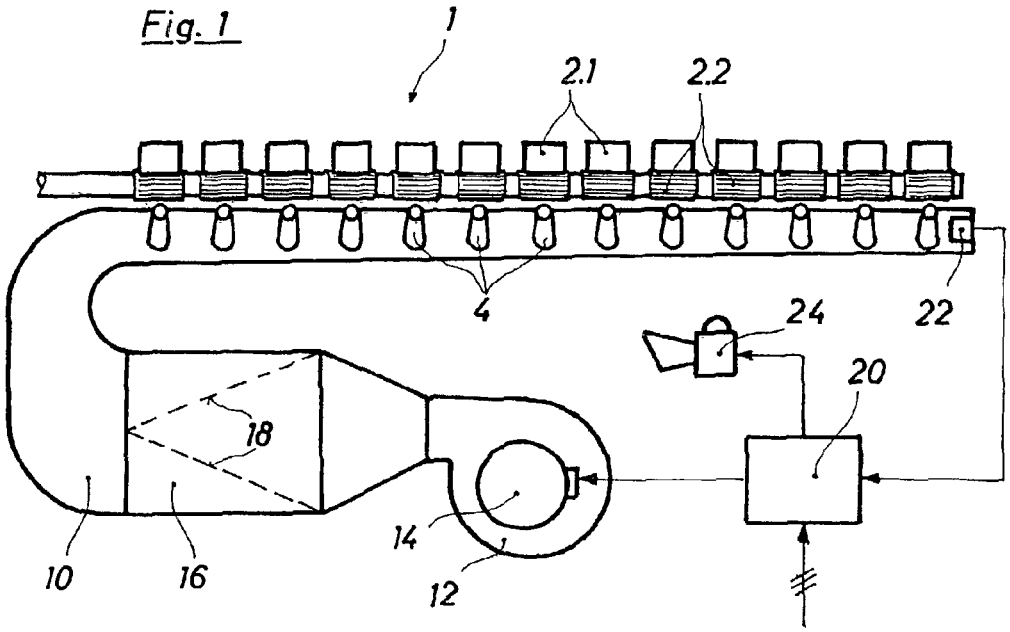
FIG. 1 is a schematic illustration of a thread break suction unit.

FIG. 1 schematically shows a ring-spinning machine 1 with a drafting frame having a number of output upper rollers 2.1 and output lower rollers 2.2. Below these output lower rollers 2.2 are found suction tubes 4 forming part of a thread break suction unit. This suction unit 10 has a filter box 16 with filter plates 18, a blower 12 and a blower motor 14. The blower motor 14 is connected with a control unit 20 with at least one sensor 22 and an optically and/or acoustically effective signal device 24.

Figure 2:
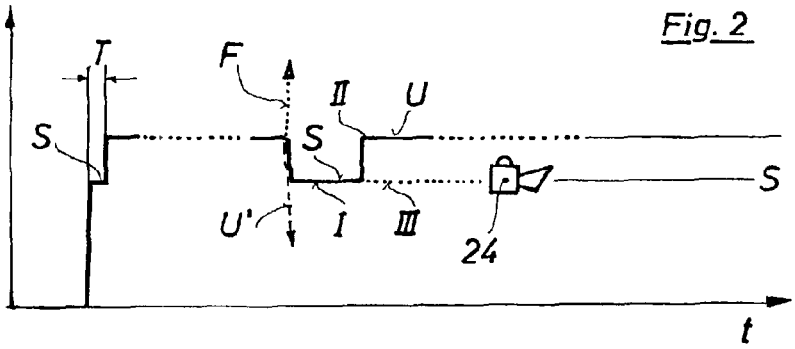
FIG. 2 is a process diagram of the device shown in FIG. 1.

With the aid of this device according to the invention, the diagram shown in FIG. 2 is obtained and in which the magnitude of the suction pressure has been plotted against the time axis t. After starting of the ring-spinning machine, the blower motor 14 is driven via the control device 20 with an—unregulated—speed which produces a standard suction pressure S which is generally functionally correct, i.e. is sufficient to draw in the thread residues. The speed of the motor which is referenced to as the standard speed, is the normal speed of the motor at line voltage, the usual line frequency and motor operating conditions without speed control. The standard suction pressure is the suction pressure which will be generated in that unit at the standard speed.

When, after the passage of a brief time span T, the sensor 22 establishes that this suction pressure S has been reached and thus that the thread break suction unit 10 is operating properly, the control device 20 is switched into its control mode. In the control mode the blower motor 14 is controlled to operate with a speed whereby a selected subatmospheric pressure U is reached. In the illustrated example, this selected suction U is higher than the standard suction pressure S, although it can also be lower.

When, via the sensor 22 in the course of operation of the ring-spinning machine 1, a clearly falling underpressure U' is detected—FIG. 1—the control will increase the speed of the blower 14 sharply or, upon an increase, will decrease the speed of the blower. When the falling suction pressure U' is simulated, for example by a failure of the sensor 22, the instantaneous suction pressure rises sharply according to the arrow F and can give rise to yarn defect thread breaks and the like. However, also when the drop in suction pressure U' has its origin in the opening of the filter box 16 to remove the collected materials, there is a shock-like increase in the suction pressure upon closure of the filter box until it is compensated for by the control operation. To avoid such fluctuations in the applied suction pressure, the control device 20 is shut off in such cases and the blower motor 14 is operated at its standard speed. This attempt at least to restore the standard suction pressure S and to hold it so that the machine will retain the operative suction in the thread break suction unit. If the pressure drop is not prevented by a blockage of the suction line of the thread break suction unit, this can be obtained with the standard suction draw.

When the sensor 22 again detects the standard suction draw S—region I—the control device 20 is switched after a brief time again to its control mode and thus the control suction pressure U is reached—region II. When this is not the case and the blower motor 12 must be operated for lengthy periods at the standard speeds—region III, it is determined that a continuing defect state has arisen. The control device 20 notes this by switching on the signal device 24 so that the defect can be monitored and eliminated.

When the sensor 22 does not detect a suction pressure, the possibility must be reckoned with that there has been plugging of the suction line of the thread-break suction unit 10. Since this means that fibrous material will not be drawn off, this can lead to entrainment of the fibrous material in the bobbin and thus to machine defects. In this case the time interval for operating the signalling device is selected to be very short or the ring-spinning machine 1 is completely turned off.

The device of the invention thus allows the ring-spinning machine to remain operable even in the case of failure of control. The startup with the standard speed of the blower motor at the beginning has the result that control via the control device 20 is activated only in the case of an intact suction unit 10, for example with a closed door of the filter box.

According to the invention it is also provided that the standard speed of the blower motor 14 is effective both with a sharp increase as well as a sharp decrease of the suction pressure. Over all a method and device is obtained which, by comparison with the state of the art, reacts more precisely to situations arising in practice.

We claim:

1. A method of operating a broken-thread suction unit of a roving or spinning machine, said method comprising the steps of:

(a) providing a suction blower with a plurality of nozzles juxtaposed with roving or spinning stations for drawing yarn residues into said nozzles;

(b) starting said blower at an unregulated standard speed with an electric motor having said standard speed whereby a suction level characteristic of said standard speed is reached sufficient to ensure that said residues will be drawn into said supply and said unit; and (c) thereafter controlling the speed of said motor to establish and maintain a predetermined suction level sufficient to ensure that yarn residues will be drawn into said unit.

2. The method according to claim 1, wherein the standard speed lies within a fixedly determined range.

3. The method according to claim 1 which comprises switching back to the standard speed when a detected suction pressure (U) exceeds or understeps predetermined limits, after which the control is reactivated when a certain suction pressure is achieved.

4. The method according to claim 3, wherein the suction pressure (U) is a sensor-determined suction pressure.

5. The method according to claim 1, further comprising triggering a failure signal when the standard speed is applied for a predetermined time period.

6. The method according to claim 5, wherein the time period is adjustable.

7. The method according to claim 1 wherein during a sharp increase and a sharp drop in the suction pressure, a switchover to the standard speed is effected.

8. In a roving or spinning machine having a multiplicity of roving or spinning stations and a broken-thread suction unit with a blower driven by a blower motor and a multiplicity of nozzles juxtaposed with the roving or spinning stations for drawing yarn residues into said nozzles and said unit, the combination therewith of an apparatus for controlling the suction by a speed change of the blower motor, comprising a control device connected with the blower motor to achieve a standard suction pressure (S) at a predetermined standard speed of the motor and then controlling the speed to a set suction pressure (U) after an initial start-up period, the control device being connected with a sensor for detecting the suction pressure (U) of the broken thread suction unit and with a signal device.

* * * * *